US009325067B2

(12) United States Patent
Ali et al.

(10) Patent No.: US 9,325,067 B2
(45) Date of Patent: Apr. 26, 2016

(54) TUNABLE MULTIBAND MULTIPORT ANTENNAS AND METHOD

(71) Applicant: BlackBerry Limited, Waterloo (CA)

(72) Inventors: Shirook M. Ali, Milton (CA); Mark E. Pecen, Waterloo (CA); James Paul Warden, Fort Worth, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 128 days.

(21) Appl. No.: 13/973,876

(22) Filed: Aug. 22, 2013

(65) Prior Publication Data

US 2015/0054699 A1 Feb. 26, 2015

(51) Int. Cl.

| | |
|---|---|
| ***H01Q 1/36*** | (2006.01) |
| ***H01Q 5/00*** | (2015.01) |
| ***H01Q 5/35*** | (2015.01) |
| ***H01Q 9/14*** | (2006.01) |
| ***H01Q 9/42*** | (2006.01) |
| ***H01Q 5/321*** | (2015.01) |
| ***H01Q 5/335*** | (2015.01) |
| *H01Q 1/24* | (2006.01) |

(52) U.S. Cl.

CPC . *H01Q 5/35* (2015.01); *H01Q 1/36* (2013.01); *H01Q 5/321* (2015.01); *H01Q 5/335* (2015.01); *H01Q 9/145* (2013.01); *H01Q 9/42* (2013.01); *H01Q 1/241* (2013.01); *Y10T 29/49016* (2015.01)

(58) Field of Classification Search

CPC ..... H01Q 1/36; H01Q 1/241; H01Q 5/35; H01Q 5/314; H01Q 3/321; H01Q 3/328; H01Q 3/335

See application file for complete search history.

(56) References Cited

U.S. PATENT DOCUMENTS

| | | | | |
|---|---|---|---|---|
| 6,476,769 | B1 | 11/2002 | Lehtola | |
| 6,573,869 | B2 | 6/2003 | Moore | |
| 7,671,804 | B2 * | 3/2010 | Zhang et al. | 343/700 MS |
| 8,648,756 | B1 * | 2/2014 | Desclos et al. | 343/747 |
| 2003/0098812 | A1 | 5/2003 | Ying et al. | |
| 2006/0178116 | A1 | 8/2006 | Qi et al. | |
| 2008/0122712 | A1 | 5/2008 | Chen | |
| 2013/0102357 | A1 * | 4/2013 | Vance | 455/550.1 |
| 2013/0203364 | A1 * | 8/2013 | Darnell et al. | 455/77 |
| 2014/0292602 | A1 * | 10/2014 | Suzuki et al. | 343/749 |

FOREIGN PATENT DOCUMENTS

WO WO 2013076894 A1 * 5/2013

OTHER PUBLICATIONS

Extended European Search report mailed Dec. 19, 2014; in European patent application No. 14169917.3.

X. L. Sun, S. W. Cheung, and T. I. Yuk, "Frequency-tunable Antenna for Dual-band WLAN Applications", Progress in Electromagnetics Research Symposium Proceedings, KL, Malaysia, Mar. 27-30, 2012.

(Continued)

*Primary Examiner* — Amal Patel

(74) *Attorney, Agent, or Firm* — Fish & Richardson P.C.

(57) ABSTRACT

An antenna, comprising a plurality of feed points and tuning elements for tuning a resonant frequency at each feed point independently of the others of the plurality of feed points. The tuning elements are placed on the configured radiating element such that for a given feed point its tuning element is placed on the configured radiating element where a current distribution of the other feed points is a minimum.

18 Claims, 9 Drawing Sheets

(56) References Cited

OTHER PUBLICATIONS

Nader Behdad and Kamal Sarabandi, "Dual-Band Reconfigurable Antenna With a Very Wide Tunability Range," IEEE Transactions on Antennas and Propagation, vol. 54, No. 2, Feb. 2006.

Tero Ranta, Duncan Pilgrim, and Richard Whatley, "Adapting to a multi-band future," Peregrine Semiconductor Europe, Apr. 11, 2012; downloaded from http://www.wireless-electronicspecifier.com/RF-Microwave/Adapting-to-a-multi-band-future.asp on Jun. 28, 2013.

Hassan Tariq Chattha, "Polarization and Pattern Diversity-Based Dual-Feed Planar Inverted-F-Antenna", IEEE Transactions on Antennas and Propagation, vol. 60, No. 3, Mar. 2012.

Nguyen Khac Kiem, Dang Nhu Dinh The Viet and Dao Ngoc Chien.; "A Novel Design of Dual-Feed Single—Element Antenna for 4G MiMo Terminals", Progress in Electromagnetics Research Symposium Proceedings, Mar. 27-30, 2012.

Frank Caimi and Mark Mongomery; "Dual-Feed Single-element Antenna for WiMax MIMO Application", vol. 2008, Article ID 219838, 5 pages doi: 10.115512008/219838, Published 2008.

* cited by examiner

TUNABLE MULTIBAND MULTIPORT ANTENNAS AND METHOD

FIELD OF THE DISCLOSURE

The present disclosure relates to antennas and more particularly to antennas and methods for multiband multiport antennas having independently tunable frequency bands.

BACKGROUND

Typical multiple frequency band (multiband) antennas have one part of the antenna active for one band, and another part active for a different band. A multiband antenna may have lower than average gain or may be physically larger than equivalent single band antennas. The design of antennas for mobile wireless communications are dictated by a number of factors, but mainly the volume available for the antenna, the frequency (directly related to this volume) of operation and unique environmental constraints of the wireless communication path (also related to frequency of operation), such as the distance over which wireless communication is to be performed, path loss and such like.

Antennas focus radiated RF energy in it radiation pattern such that there appears to be more power coming from the antenna in a particular direction. The electrical characteristics of an antenna, such as gain, radiation pattern, impedance, bandwidth, resonant frequency and polarization, are the same whether the antenna is transmitting or receiving.

The term antenna gain describes how much power is transmitted in the direction of peak radiation to that of an isotropic source. Gain is a key performance figure which combines the antenna's directivity and electrical efficiency. Antenna gain is usually defined as the ratio of the power produced by the antenna from a far-field source on the antenna's beam axis to the power produced by a hypothetical lossless isotropic antenna, which is equally sensitive to signals from all directions. Usually this ratio is expressed in decibels, and these units are referred to as "decibels-isotropic" (dBi). An alternate definition compares the antenna to the power received by a lossless half-wave dipole antenna, in which case the units are written as dBd.

Antenna gain is sometimes referred to as a function of angle, but when a single number is quoted the gain is the 'peak gain' over all directions.

Directivity measures how much more intensely the antenna radiates in its preferred direction than a mythical "isotropic radiator" when fed with the same total power. It follows then that the higher the gain of an antenna the smaller the effective angle of use. This directly impacts the choice of the antenna for a specific function. To achieve a directivity which is significantly greater than unity, the antenna size needs to be much larger than the wavelength. This can usually achieved using a phased array of half-wave or full-wave antennas. Since a phased array is comprised of a number of individual physically separate antennas, a phased array is not an adequate solution for particular mobile wireless communications due to the size of the aggregated individual antennas plus the gap distance between them.

An antenna radiation pattern is a graphical representation of the intensity of the radiation versus the angle from a perpendicular to a plane of the antenna. The graph is usually circular, the intensity indicated by the distance from the centre based in the corresponding angle. The radiation pattern may be used to determine the beamwidth which is generally accepted as the angle between the two points (on the same plane) at which the radiation falls to "half power" i.e. 3 dB below the point of maximum radiation.

Antenna impedance relates the voltage to the current at the input (feed port) to the antenna. The real part of the antenna impedance represents power that is either radiated away or absorbed within the antenna. The imaginary part of the impedance represents power that is stored in the near field of the antenna. This is non-radiated power. An antenna with only a real part input impedance (zero imaginary part) is said to be resonant. Note that the impedance of an antenna will vary with frequency. A common measure of how well matched the antenna is to the feed line (transmission line) or receiver is known as the Voltage Standing Wave Ratio (VSWR). VSWR is a real number that is always greater than or equal to 1. A VSWR of 1 indicates no mismatch loss (the antenna is perfectly matched to the transmission line). Higher values of VSWR indicate more mismatch loss.

Although a resonant antenna has by definition an almost purely resistive feed-point impedance at a particular frequency, many (if not most) applications require using an antenna over a range of frequencies. An antenna's bandwidth specifies the range of frequencies over which its performance does not suffer due to a poor impedance match. Bandwidth is typically quoted in terms of VSWR. For instance, an antenna may be described as operating at 100-400 MHz with a VSWR<1.5. This statement implies that the reflection coefficient is less than 0.2 across the quoted frequency range. Hence, of the power delivered to the antenna, only 4% of the power is reflected back to the transmitter. Alternatively, a return loss S11=20*log 10(0.2)=−13.98 dB. Note that the above does not imply that 96% of the power delivered to the antenna is transmitted in the form of electromagnetic radiation; losses must still be taken into account.

Dipole antenna conductors have the lowest feed-point impedance at the resonant frequency where they are just under ¼ wavelength long. The reason a dipole antenna is used at the resonant frequency is not that the ability of a resonant antenna to transmit (or receive) fails at frequencies far from the resonant frequency but has to do with the impedance match between the antenna and the transmitter or receiver (and its transmission line). Also in a half wave dipole antenna there is a natural peak in current distribution when fed at the centre. This type of antenna consists of two quarter wavelength sections fed exactly at the centre, where the wavelength lambda=c/f times the velocity factor of the dielectric medium surrounding the antenna, e.g. in the case of air, the velocity factor is approximately 0.95, which makes each section slightly less than a quarter wavelength (c=speed of light and f=resonant frequency).

As mentioned earlier, higher the gain of an antenna the smaller the effective angle of use. This directly impacts the choice of the antenna for a specific function. In mobile cellular applications the factors discussed above play an important consideration in trying to realize a small form factor efficient antenna.

Mobile devices more commonly have to operate on more than one frequency band, typically different portions of frequency spectrum thus requiring antenna designs that support multiband operation. In a conventional antenna design that supports multiband operation, a single broadband antenna has a single antenna port (feed point) connected to a single pole switch with multiple throws each connecting to different filter or duplexer units. Typically these filters incur losses of 0.5-0.7 dB when measured in a 500 system. In addition the switches also consume power, add a degree of non-linearity and have losses of 0.3-0.5 dB. Greater losses may be expected when the switches and diplexing networks are connected to an antenna due to inevitable mismatch.

With the deployment of LTE bands that currently extend towards the 700 MHz frequency and the upcoming deployment of LTE-A with Carrier Aggregation (CA), one can expect the need for a greater number of throws in the antenna switch for connecting to a larger number of filtering units. This imposes further challenges and potentially a need for additional antennas; especially if a single device for worldwide usage is to be designed as not all countries use the same frequency bands.

In a single port, multi-band antenna having multiple resonant frequencies generally leads to antenna design complexities. Single port multiband antennas are difficult to tune effectively for operation over the desired multiple frequency bands. For example, it is possible to obtain a dual-band antenna by choosing locations of varactors appropriately along the antenna so that first and second resonant frequencies can be controlled individually. In other words, the frequency of either the first or the second band can be fixed, while the other one is electronically tuned.

On the other hand, a multi-band antenna having multiple antenna feed points (multiport) tends to reduce antenna design complexities since the design of a plurality of individual radiating/receiving elements, each having a separate feed, tends to be less difficult. However, multiple antenna feeds encounter the problem of mutual coupling between the individual radiating/receiving elements of a multi-band antenna. There is also a concern that a multi-band antenna with multiple antenna feed ports may have its performance compromised due to mutual coupling and poor isolation between the antennas various resonant bands. For example dual-feed, dual-band, PIFAs have been used for cellular mobile wireless applications. However, most of these dual-feed, dual-band, PIFAs exhibit an isolation of only about 15 dB, degraded gain at the individual antenna ports. And employ both physical and electrical separation between the radiating/receiving elements which also involves a change in the linear dimensions of the separate radiating elements resulting in increased overall physical volume

BRIEF DESCRIPTION OF THE DRAWINGS

The present disclosure will be better understood with reference to the drawings in which.

DETAILED DESCRIPTION

Figure 1:
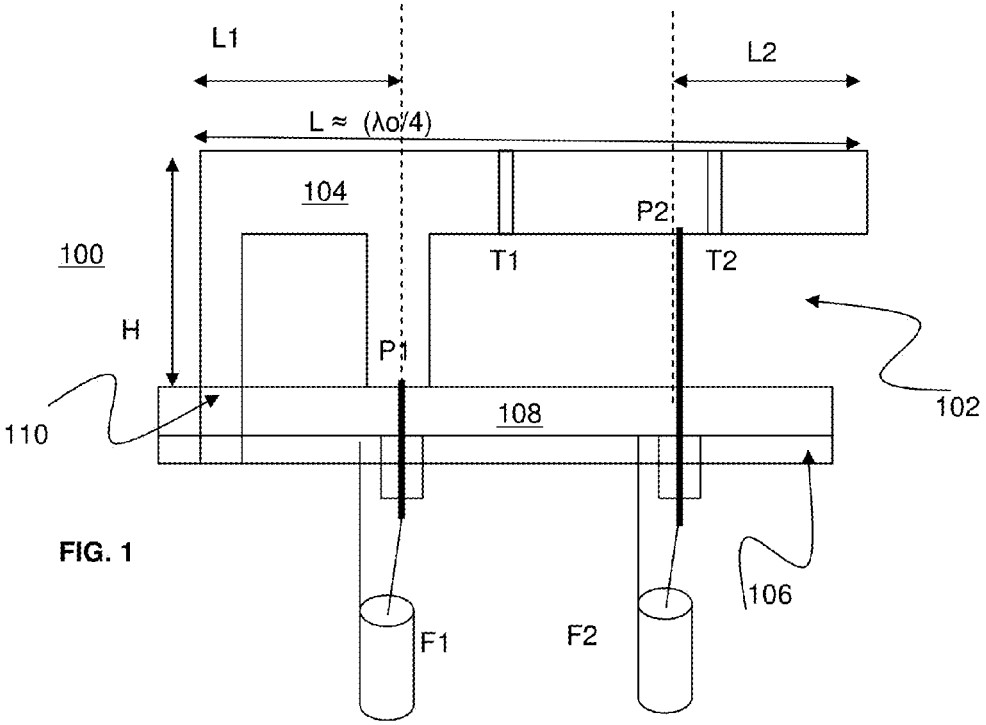
FIG. 1 shows a schematic side view of an inverted F antenna (IFA) according to an embodiment of the present matter.

In the following description: like numerals refer to similar structures or features in the drawings; the term feed-point is used to generally mean a location, point or port on an antenna radiating element to which a signal may be coupled to or from the radiating element via a feed-line (or transmission line or feed), either by direct connection or indirectly (e.g. aperture feed, or gap feed); and the term feed is used to generally mean an active coupling of signals between the antenna radiating element and a transmitter or receiver or other circuit element.

In one aspect the present matter mitigates to some extent challenges posed by multiband mobile wireless communication applications by providing a multi-feed multiband antenna. The multi-feed antenna may reduce switch loses as well as the number of switch/diplex units and the number of throws and thus its size.

Furthermore, multiport antennas according to a further aspect of the present matter introduce a degree of freedom in the design of multiband antennas which in turn may assist in improving antenna performance due to easing of design constraints. For example by having multiple feeds, the number of frequency bands that each feed covers may be reduced, thus matching networks for the antenna may be easier to design since they cover a narrower bandwidth encompassing fewer frequency bands for a particular feed as opposed to having a broadband matching network with a single feed antenna. It is to be noted that design considerations for multiport multiband antennas can be distinguished from multiport single band antennas, the latter being used for example in diversity applications, over one frequency band.

A further aspect of the present matter provides for a mechanism in the antenna design to tune a frequency band which adds yet another degree of freedom in the antenna design. For example where a bandwidth for a particular feed is narrower but tunable to different centre frequencies better antenna performance can be achieved while at the same time having more of the narrower bandwidth feeds covering other bands.

In a still further aspect the present matter provides circuit elements in the antenna design to allow a frequency of an antenna feed to be independently tunable with respect to other feeds. This permits different bands covered by a feed to be tuned without affecting the other bands, resulting in easier and more flexible multiband antenna design.

Thus the present matter provides a system and method for a tunable antenna in which the antenna has one or more characteristics of high efficiency in both low and high bands, requires no ground conductor removal in a vicinity of the antenna radiating elements, independently tunable and reconfigurable feed frequency bands.

In a specific embodiment the antenna is a dual band antenna with one feed covering low bands ranging from 700-960 MHz and another of the feeds covering high bands from 2400-2690 MHz. However this is exemplary and may encompass more or different bands.

The present matter provides an antenna and method for constructing an antenna having multiple feeds with independently tunable frequency bands.

In accordance with an embodiment of the present matter there is provided an antenna, comprising: a plurality of feed points; and at least one tuning element for tuning a resonant frequency at one of the plurality of feed points independently of the others of the plurality of feed points.

In accordance with a further aspect there is provided that the antenna includes a radiating element configured to have a fundamental resonance frequency being regarded as a first harmonic resonance frequency $f_o$; one or more feed points positioned on the configured radiating element at locations on the antenna, the location of each feed point for exciting a particular mode of the antenna when coupled to a feed.

In accordance with a further aspect, the location of the feed points are determined by using a current distribution of on the configured radiating element.

In accordance with a further aspect the location of the feed points are determined using a current distribution of on the configured radiating element where multiples of the first harmonic resonance frequency have current maxima.

In accordance with a still further aspect the tuning elements are placed on the configured radiating element such that for a given feed point its tuning element is placed on the configured radiating element where a current distribution of the other feed points is a minimum.

In accordance with a still further aspect the tuning elements are placed on the configured radiating element such that for a given feed point its tuning element is placed on the configured radiating element where a current distribution of the other feed points is a minimum so that changing value of the tuning element does not change a resonant frequency of the other feed points.

In accordance with a still further aspect the tuning elements are capacitors.

In accordance with another embodiment of the present matter there is provided a method for constructing an antenna comprising configuring a radiating element with a plurality of feed points; and placing tuning elements on the configured radiating element for tuning at least one feed point independently of the others of the plurality of feed points.

In accordance with any of the embodiments, each of the antenna feed points is configured to operate in separate frequency bands.

In accordance with another embodiment of the present matter there is provided a wireless communications device comprising a multiple port multiple frequency band antenna structure having a contiguous radiating element, each of the multiple ports operable in a respective one of the multiple frequency bands; and tuning elements for tuning a resonant frequency at one of the multiple ports independently of the resonant frequency of others of the multiple ports.

In accordance with any of the above aspects and embodiments the tuning elements are placed on the antenna where current distributions of the other ports are a minimum.

In accordance with any of the above aspects and embodiments there is included determining a location of a current minimum for the others of the plurality of feed points.

In accordance with any of the above aspects and embodiments there is included determining a value of the tuning element for the resonant frequency of the at least one feed point and connecting the determined tuning element at said location of the current minimum.

In accordance with any of the above aspects and embodiments there is included operating said antenna with one of said plurality feed points open, wherein the antenna forms an antenna structure of a first type operable in a first frequency band; and operating said antenna with another of said plurality feed points open, wherein the antenna forms the antenna structure of a second type operable in a second frequency band.

In accordance with any of the above aspects and embodiments a change in a geometric dimension of said antenna structure of said first type or said second type changes said respective first frequency band or second frequency band independently.

In accordance with any of the above aspects and embodiments each of the plurality of feed points is connected to a respective front end of a mobile device.

In accordance with any one of the preceding aspects and embodiments the antenna is mounted directly over a ground plane.

Referring to FIG. 1 there is shown geometry of an inverted F antenna (IFA) 100 according to an embodiment of the present matter. The antenna 100 includes a radiating element 102 composed of an upper arm 104 of a length L that is roughly a quarter of a wavelength corresponding to a fundamental resonance frequency being regarded as a first harmonic resonance frequency $f_o$. The upper arm is spaced a distance H above a ground plane conductor 106 formed on a bottom surface of a substrate 108. A first feed point P1 is located on the upper arm a small distance L1 from one end of the upper arm. A shorting pin 110 transmission line is placed from the ground plane 106 to the upper arm of the IFA to the left of the feed (as shown in FIG. 1), at the one end. The feed is closer to the shorting pin than to the open end of the upper arm. The polarization of this antenna is vertical, and the radiation pattern is roughly donut shaped, with the axis of the donut in the vertical direction. The ground plane is as wide as the IFA length, the height H of the IFA is a small fraction of a wavelength. A second feed point P2 is located on the upper arm a small distance L2 from the open end of the upper arm. Feeds (for example, a coaxial cable) F1 and F2 may be connected to feed point P1 and P2 respectively. First and second tuning elements T1 and T2 are placed on the radiating element, with the first tuning element T1 for tuning the resonant frequency of feed point P1 and the second tuning element for tuning the resonant frequency of feed point P2. It may be seen that the radiating structure 104 resembles a typical IFA, with an additional feed point P2 and tuning elements T1 and T2. As mentioned above the radiating element 102 is configured with an overall length roughly a quarter of a wavelength of the fundamental resonant frequency. The feed points P1 and P2 are then positioned on the configured radiating element at locations on the antenna radiating element that excite a particular mode of the antenna when coupled to a feed. For example the first feed point P1 may excite a fundamental mode, whereas feed the second feed point P2 may excite a second harmonic (or other multiple) of the fundamental. In this case placement of the second feed point may be made by determining where a current maxima of the second harmonic frequency (or multiple thereof) occurs and placing the second feed point P2 in that general location. Other placement of the feed points may also be made dependent on a desired resonant frequency of the feed bands.

In one example the substrate is Pyralux TK, with a relative dielectric constant ∈r=0.5, and loss tangent tanDelta=0.002. A thickness of the substrate 108 is 0.1 mm.

Figure 2:
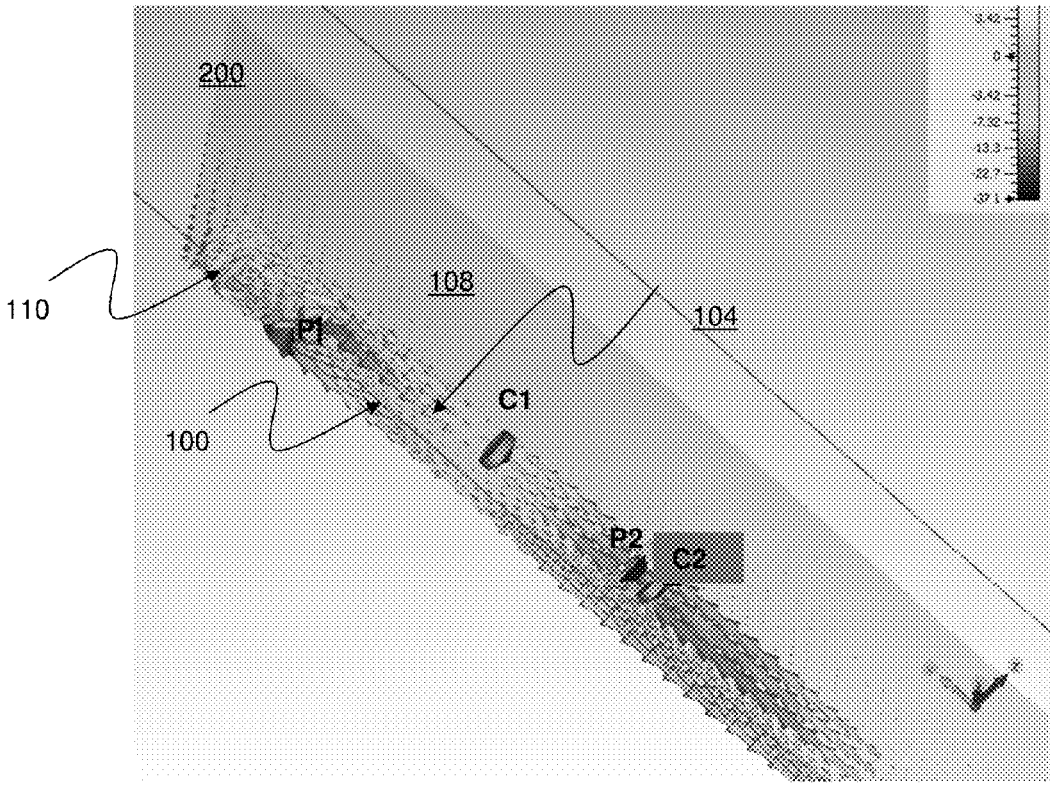
FIG. 2 shows a modeled current distribution for the IFA according to an embodiment of the present matter.

Referring to FIG. 2 there is shown a modeled current distribution 200 with the second feed point P2 active for the antenna 100. In this embodiment the tuning elements are capacitors 202 and 204. In order to tune the resonant frequency at the second feed point, the capacitor 204 is used as the tuning element T2 having a capacitance C2 and is placed where the modeled current distribution 200 for the second feed point P2 is maximum. It is to be noted that the current distribution 200 is modeled with feed point P1 "open" or inactive thus port P1 is "invisible" to P2. Changing the capacitance value C2 will affect the second feed point P2 resonance frequency significantly and conversely will have no effect on the first feed point P1. In turn the tuning element T1 for tuning the first feed point P1 is also implemented as a capacitor with capacitance C1 and is placed in the zero current location of second feed point P2. Thus tuning the capacitance C1 of the first capacitor will only impact feed point P1.

Referring back to the schematic of the antenna 100 in FIG. 1, it may be seen that the antenna 100 may be reconfigured to provide another degree of design flexability such that the antenna 100 can support multiple antenna structures and thus different frequency bands of operation. For example if the first feed F1 is not connected i.e. feed point P1 is set open, the resultant antenna structure is a tunable imbalanced dipole antenna. This antenna structure is then fed F2 at the second feed point P2 and covers the high frequency bands.

If on the other hand the second feed F2 is not connected i.e. the second feed point P2 is set open, the resultant antenna structure is a tunable IFA that covers the low bands when fed F1 at feed point P2.

Furthermore, as seen in FIG. 1, the geometrical dimensions of the antenna 100 are flexible. For example, the portion of the radiating structure 102 excited by the second feed F2 may be modified by changing its length to cover the mid bands (by increasing the length) instead of the high bands. In the specific embodiment of the antenna 100 for example, changing the length 'L2' or 'L1' will control the resonant frequency of port 1 or 2.

Thus it may be seen from the above that each of the feeds covering a particular band category can be connected to a respective front end circuit element (not shown). Thus obviating the need for switches entirely or the need for larger switches supporting more throws.

Figure 3:
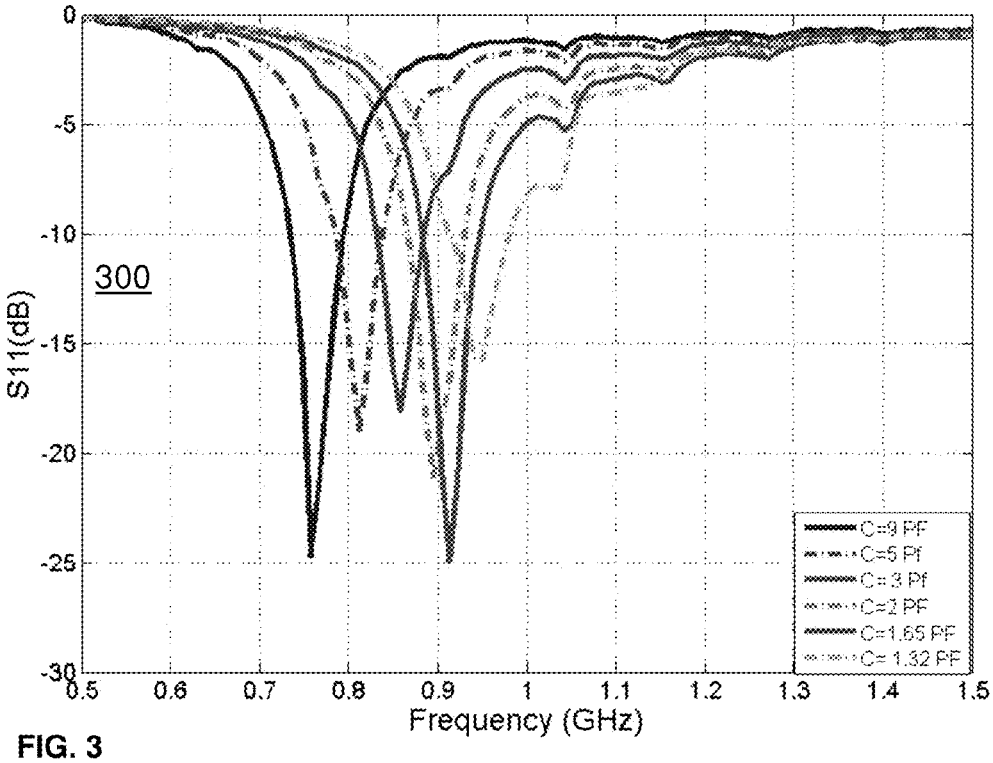
FIG. 3 is a graph of measured reflection coefficients (S11) at a first port for different values of a first tuning element.

Referring now to FIG. 3 there is shown a measured reflection coefficient (S11) at the first feed point P1 with a connected feed F1 for different values C1 of the first capacitor for the antenna 100. The measured values shown in the graph 300 are for one implementation of the antenna 100 having ground plane 106 dimensions of 110 mm×60 mm and radiating member dimensions of 5.5 mm(H)×70 mm(L). The first feed point P1 is tuned with capacitor C1 and the second feed point P2 is tuned with capacitor C2, both connected in a series configuration on the radiating element.

Figure 4:
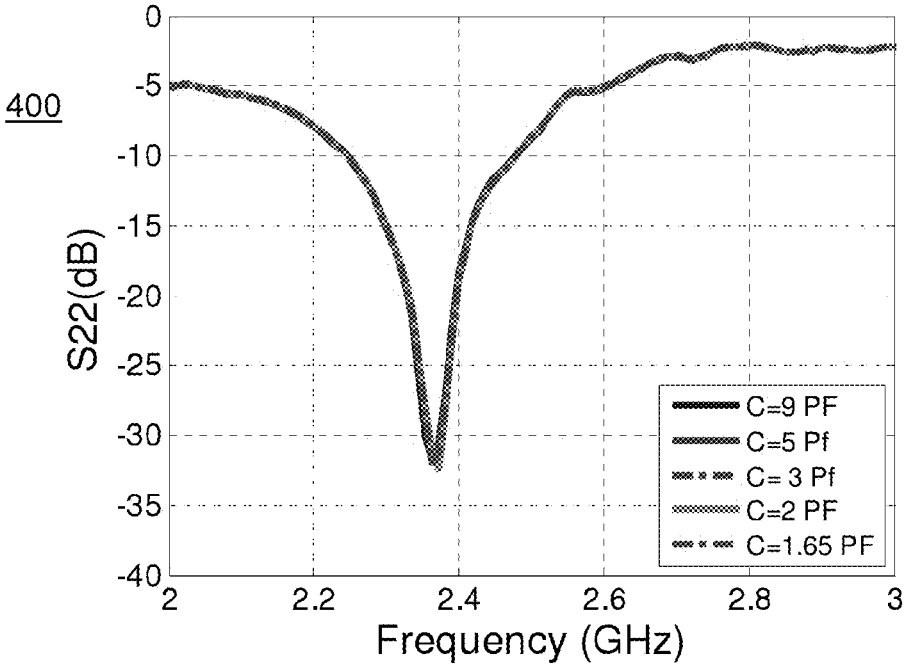
FIG. 4 is a graph of measured reflection coefficients (S22) at a second port for different values of the first tuning element.

As seen in the graph of FIG. 3, for a −5 dB bandwidth, by changing the value of capacitance C1, the first feed is tuned to cover 0.7 GHz-1.0 GHz with each value of C1 the centre (resonant) frequency of the band is shifted. The different values of C1 for which the curves are plotted in FIG. 3 are C1=9 pF, 5 pF, 3 pF, 2 pF, 1.65 pF and 1.32 pF Furthermore since C1 is placed where the current distribution of the second feed point P2 is minimum, previously referred to in FIG. 2, changing the capacitance C1 will not cause any change in the resonance frequency of the second feed point P2. This is illustrated by the graph 400 of FIG. 4 which shows a measured reflection coefficient (S22) for the second feed point P2 for the different values of C1. As may be seen the resonance frequency of the second feed point P2 is generally unaffected with different values of the capacitance C1.

Figure 5:
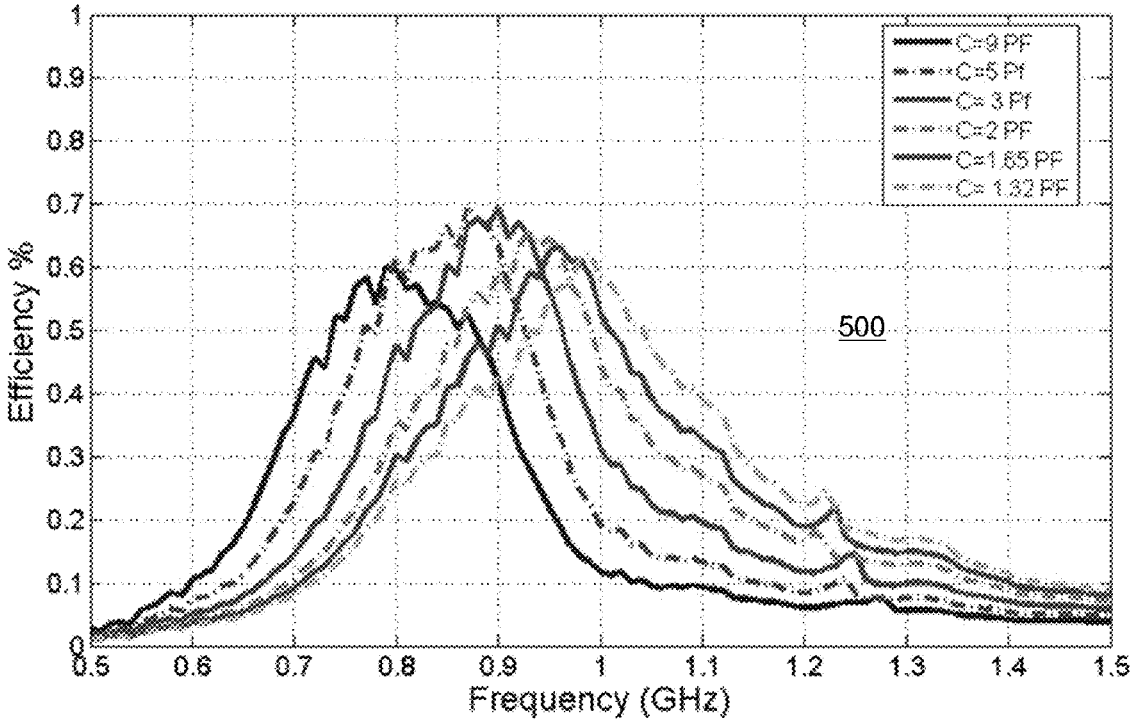
FIG. 5 is a graph of measured antenna efficiency at the first port for different values of a tuning element.
Figure 6:
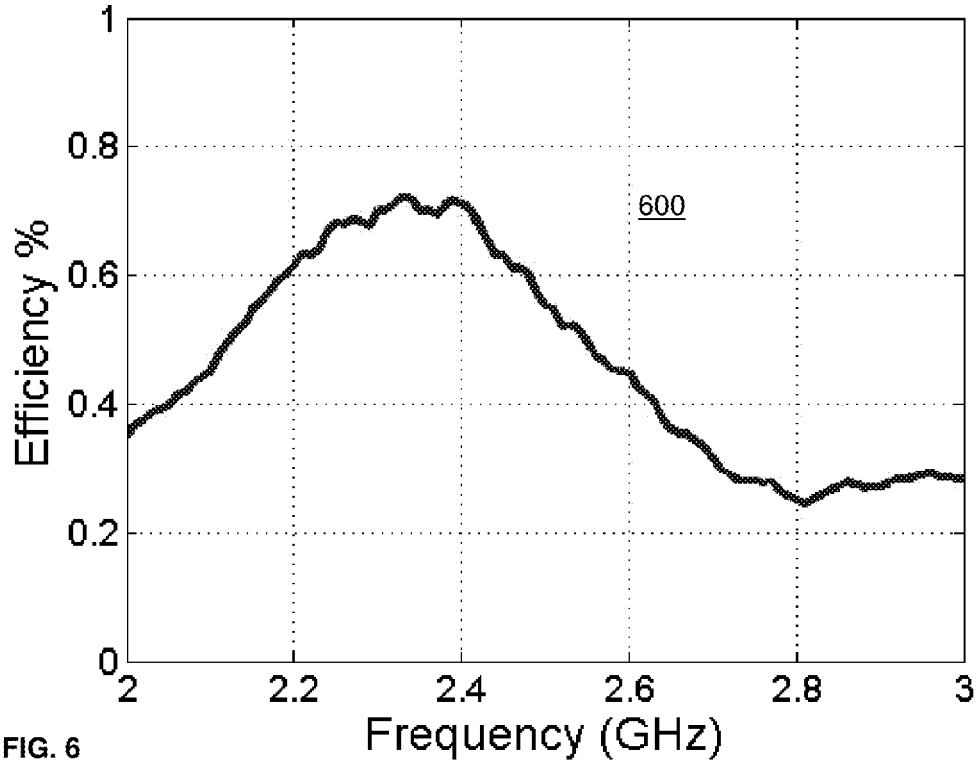
FIG. 6 is a graph of measured antenna efficiency at the second port.

The efficiency at the first feed point P1 was also measured with different values of the capacitance C1. The measured results 500 are shown in FIG. 5. As may be seen the measured efficiency is higher than 60% and the antenna radiated efficiency is expected to be even higher. The measured efficiency 600 at the second feed point for feed two F2 is shown in FIG. 6. As may be seen the efficiency is higher than 70%.

Figure 7:
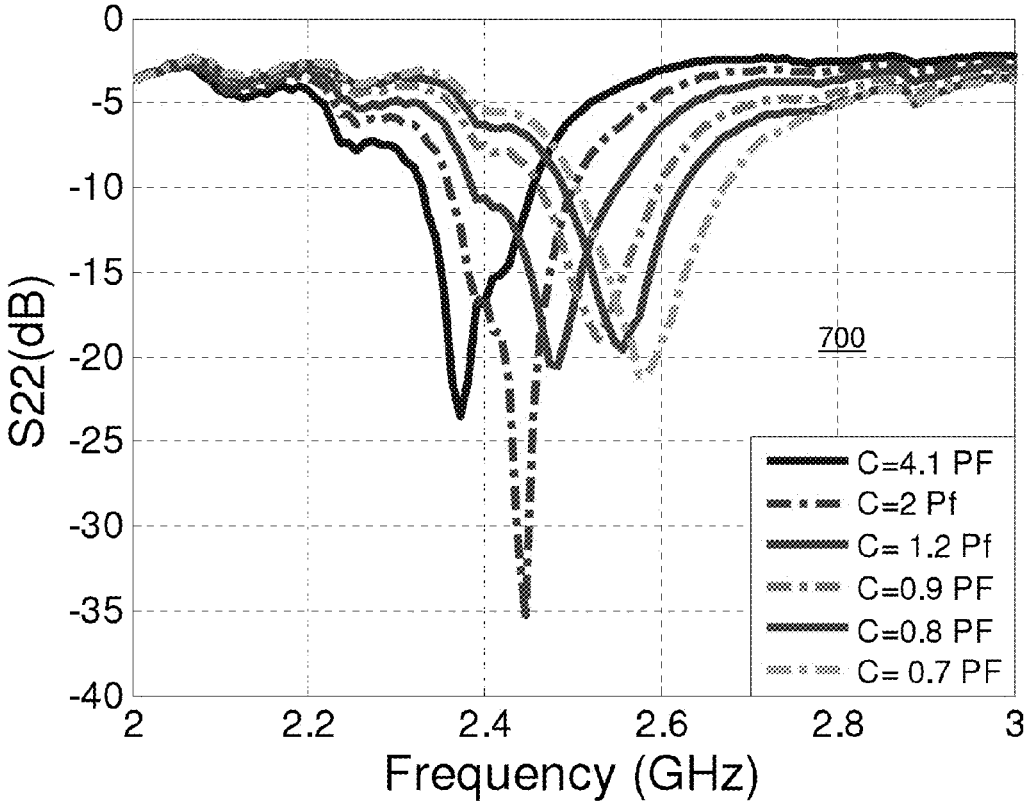
FIG. 7 is a graph of measured reflection coefficients (S22) at a second port for different values of a second tuning element.
Figure 8:
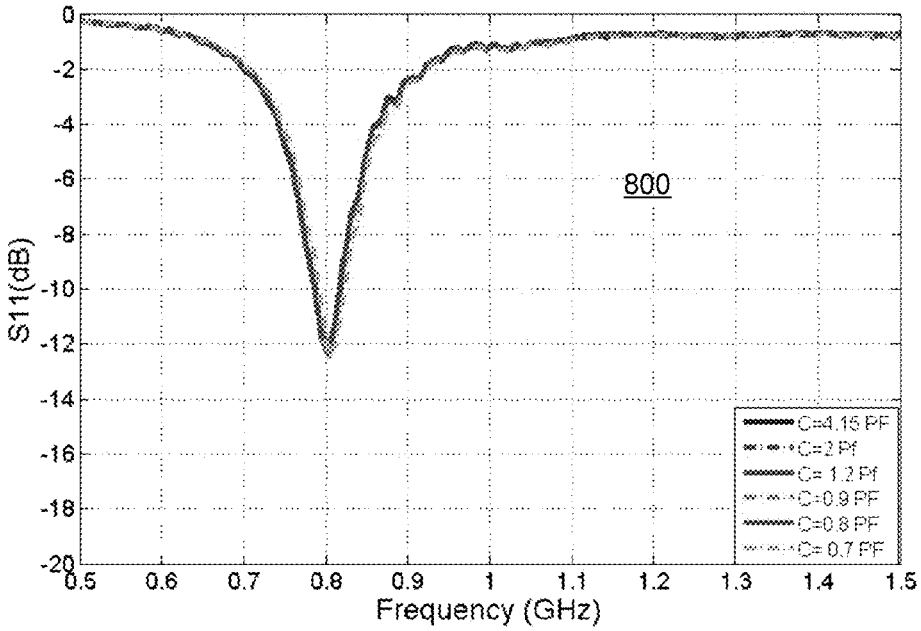
FIG. 8 is a graph of measured reflection coefficients (S11) at a first port for different values of the second tuning element.

Referring to FIG. 7 there is shown a graph 700 of the reflection coefficients (S22) of the second feed point P2 for different values of the tuning capacitance C2. A graph 800 of the reflection coefficient (S11) of the first feed point P1 is shown in FIG. 8. As may be seen with feed point P2 open, there is no change with different values of the capacitance C2.

Figure 9:
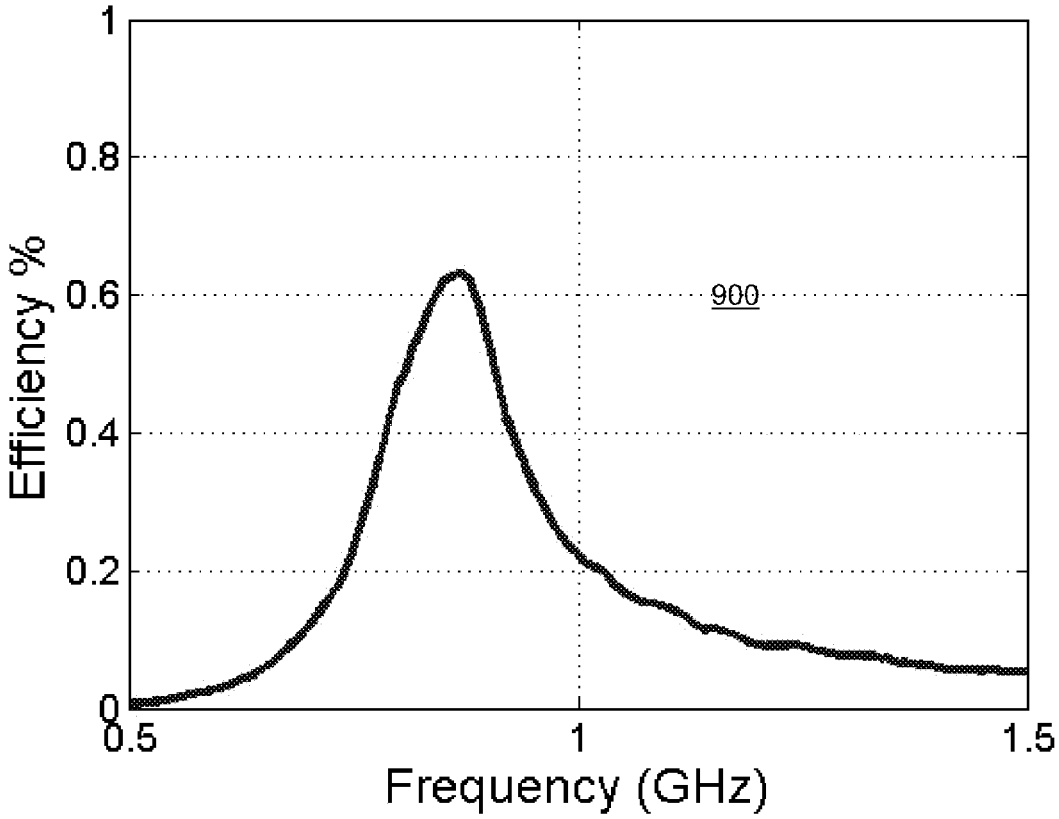
FIG. 9 is a graph of measured antenna efficiency at the first port; when tuning the second port.
Figure 10:
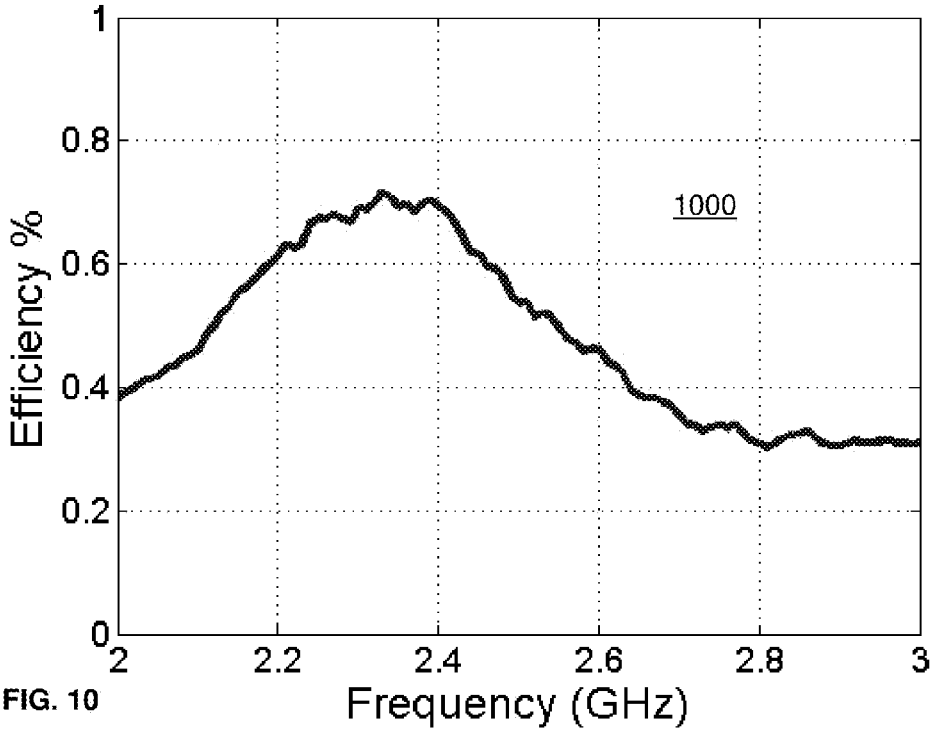
FIG. 10 is a graph of measured antenna efficiency at the second port when tuning the second port.

The measured efficiency at feed points P1 and P2 while tuning feed point P2 is shown in the graphs of FIGS. 9 and 10 respectively. As may be seen from graph 900 in FIG. 9 the efficiency at feed point P1 is higher than 60%. The efficiency at the second feed point P2 shown in graph 1000 of FIG. 10 is higher than 70%.

In a second implementation (not shown) of the antenna 100 the overall size of the radiating element may be reduced by connecting at least one of the tuning capacitors in a shunt configuration (not shown). For example in this second implementation the second capacitor C2 is now connected in a shunt configuration (can also be termed a parallel configuration) from the radiating element 104 to the ground plane 106. This implementation also as in the series configuration does not require removal of the ground plane conductor. Typically the ground area under/close to the antenna is cleared in order to obtain good performance from the antenna. However In the present matter the ground conductor does not have to be cleared and may extends to cover the whole substrate board. The antenna radiating element dimensions are 5.5 mm (H)× 58 mm (L). Since the capacitance C2 is now connected t between the radiating element and ground, this capacitance affects the first feed point and also can be used to tune the first harmonics. On the other hand the capacitance C1 (which is in series as described previously in the first implementation), however, only tunes the first feed point P1.

Figure 11:
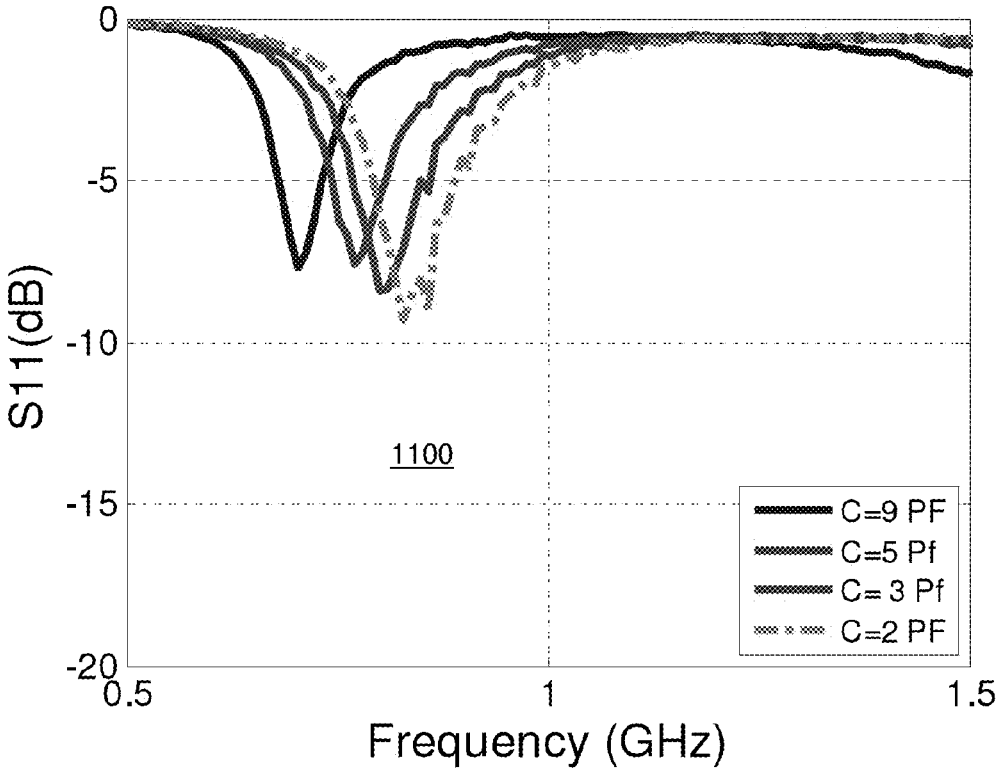
FIG. 11 is a graph of measured reflection coefficients (S11) at a first port for different values of a shunt connected tuning element.
Figure 12:
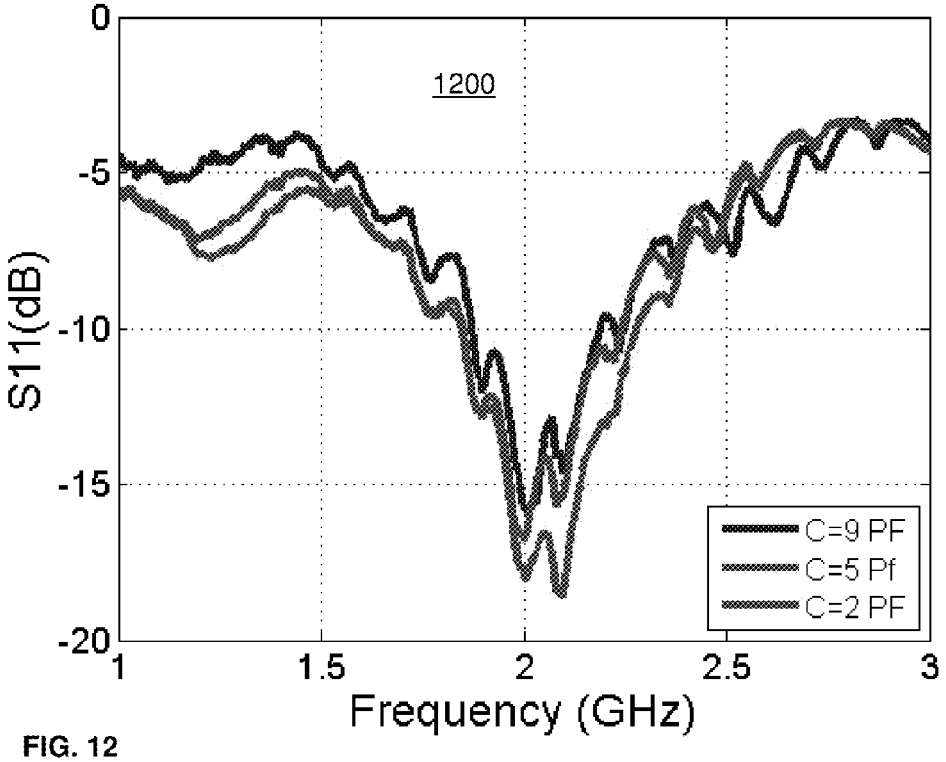
FIG. 12 is a graph of measured reflection coefficients (S22) at a second port for different values of the shunt connected tuning element.
Figure 13:
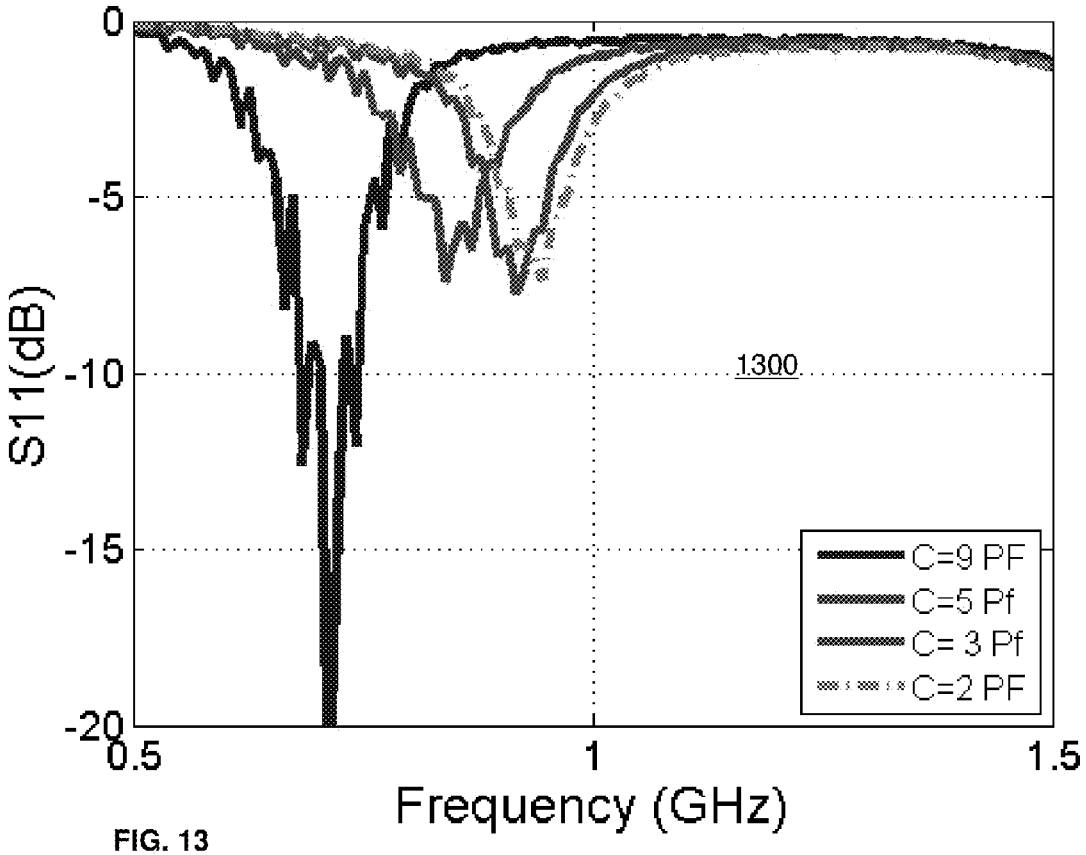
FIG. 13 is a graph of measured reflection coefficients (S11) at a first port for different values of its tuning element.

For this second implementation the measured reflection coefficients (S11) at feed point P1 while tuning the shunt capacitance C2 to different values is shown in the graph 1100 of FIG. 11. Also, the measured reflection coefficients (S22) at feed point P2 while tuning the shunt capacitance C2 to different values is shown in the graph 1200 of FIG. 12 (i.e. measured reflection coefficients of Feed 2 with different values of C2). As may be seen in FIG. 12 if there is change in the resonance frequency at the second feed point P2. This can be adjusted or tuned by adding another capacitor (not shown) in a series connection after the second feed point P2 in a manner as explained earlier. It is to be noted that the capacitance C1 does not affect the resonance of the second feed point P2. C1 can be used to tune feed point P1 as shown in the graph 1300 of FIG. 13, which shows the measured reflection coefficients of Feed 1 with different values of C1.

Figure 14:
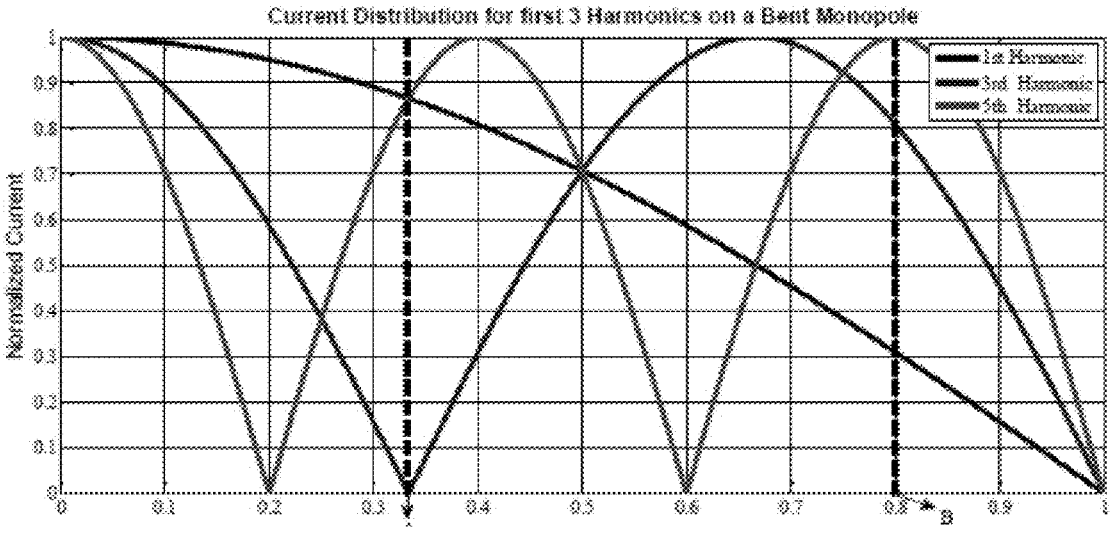
FIG. 14 is a graph of a current distribution on a bent monopole at various harmonics.
Figure 15:
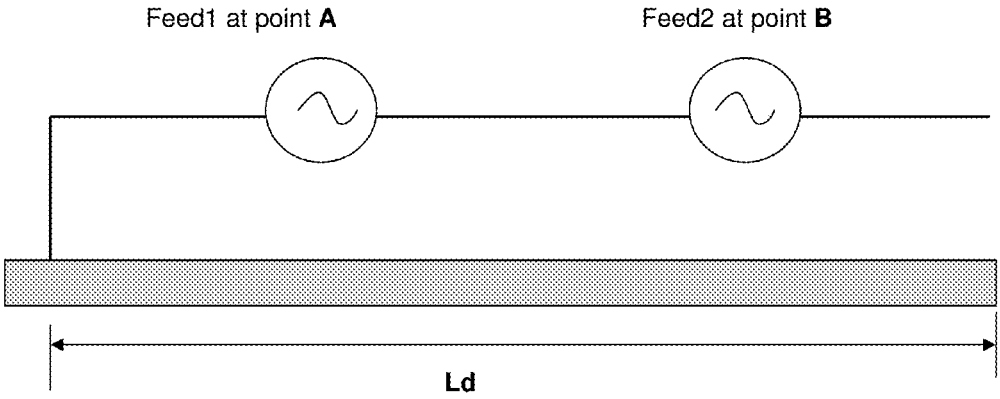
FIG. 15 is a schematic diagram of a dual feed bent dipole.

Referring to FIG. 14, there is shown a graph 1400 of a normalized current distribution versus normalized length for a wire line bent monopole antenna 1500 of length Ld schematically illustrated in FIG. 15. The current generally has a sinusoidal distribution at the various harmonics. A half wave dipole antenna (two quarter wavelength monopoles) will support odd harmonic (e.g. first, third, fifth harmonic) frequencies as may be seen from the sinusoidal current distribution 1400 of the bent monopole. In other words in a conventional half wave dipole, for the even harmonics the current is at a minimum (zero) at the feed point which means that the input impedance (V/I) is infinite i.e. no power is transferred to the antenna.

From the graph 1400 it may be seen that at the first harmonic the current has a quarter wave sinusoidal distributions with a maxima at the one end. In order to implement a dual band antenna according to embodiments of the present matter, operable at a first band with resonant frequency at the first harmonic resonant frequency and a second band with a resonant frequency at the firth harmonic a first feed or port (feed1) is located at a location A and a second feed (Feed2) or port2 is located at B at the current maxima of the fifth harmonic. Then feed port1 (A) may be tuned by placing a capacitor (or other tuning element) at a location where the operating band of feed2 has a current minima, for example at a distance 0.6 located along the normalized dipole length as shown in graph 1400.

Embodiments of the present matter may be implemented in any UE. One exemplary device is described below with regard to FIG. 16.

UE 1600 is typically a two-way wireless communication device having voice and data communication capabilities. Depending on the exact functionality provided, the UE may be referred to as a data messaging device, a two-way pager, a wireless e-mail device, a cellular telephone with data messaging capabilities, a wireless Internet appliance, a wireless device, a mobile device, or a data communication device, as examples.

Where UE 1600 is enabled for two-way communication, it may incorporate a communication subsystem 1611, including a receiver 1612 and a transmitter 1614, as well as associated components such as one or more antenna elements 1616 and 1618, local oscillators (LOs) 1613, and a processing module such as a digital signal processor (DSP) 1620. As will be apparent to those skilled in the field of communications, the particular design of the communication subsystem 1611 will be dependent upon the communication network in which the device is intended to operate. The radio frequency front end of communication subsystem 1611 can be any of the embodiments described above. One or more of the antenna elements 1616 and/or 1618 may be multiple port multiple frequency band antenna structures having a contiguous radiating element with each of the multiple ports operable in a respective one of the multiple frequency bands; and the antenna having tuning elements for tuning a resonant frequency at one of the multiple ports independently of the resonant frequency of others of the multiple ports according to embodiments described herein.

Network access requirements will also vary depending upon the type of network 1619. In some networks network access is associated with a subscriber or user of UE 1600. A UE may require a removable user identity module (RUIM) or a subscriber identity module (SIM) card in order to operate on a network. The SIM/RUIM interface 1644 is normally similar to a card-slot into which a SIM/RUIM card can be inserted and ejected. The SIM/RUIM card can have memory and hold many key configurations 1651, and other information 1653 such as identification, and subscriber related information.

Figure 16:
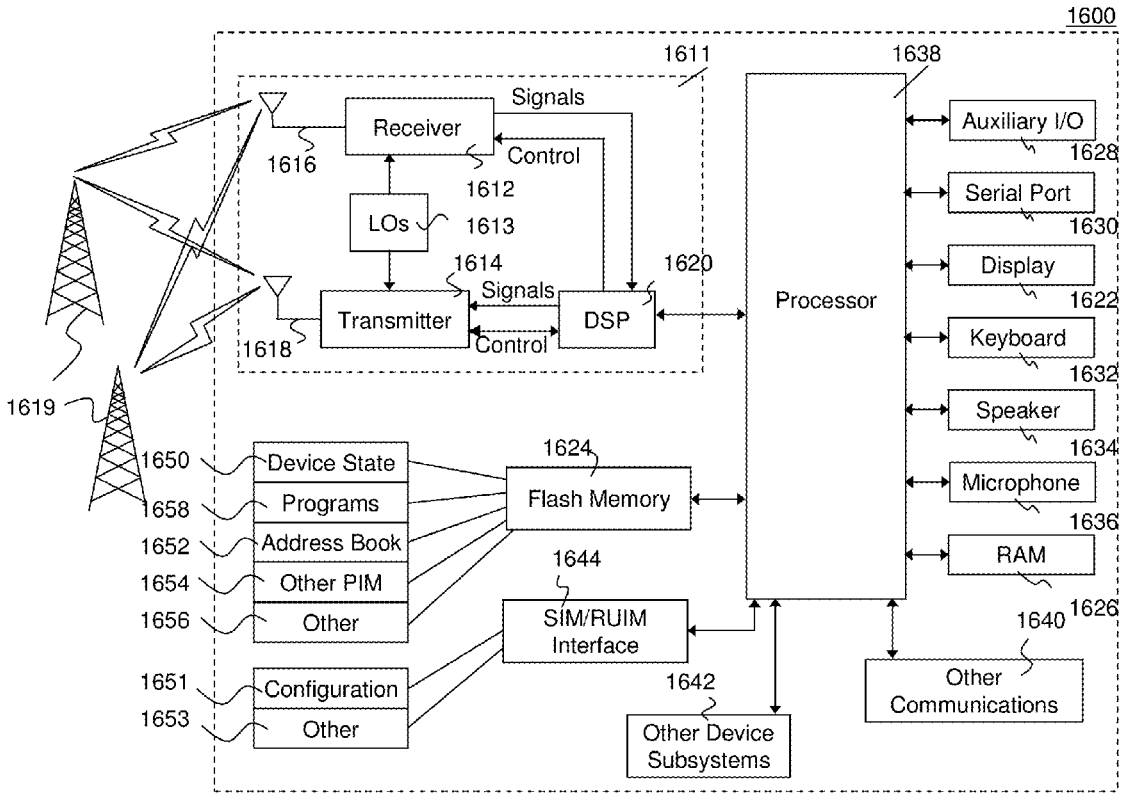
FIG. 16 is a schematic diagram of a two-way wireless communication device for which the antenna according to embodiments of the present matter may be used.

When required network registration or activation procedures have been completed, UE 1600 may send and receive communication signals over the network 1619. As illustrated in FIG. 16, network 1619 can consist of multiple base stations communicating with the UE.

Signals received by antenna 1616 through communication network 1619 are input to receiver 1612, which may perform such common receiver functions as signal amplification, frequency down conversion, filtering, channel selection and the like. ND conversion of a received signal allows more complex communication functions such as demodulation and decoding to be performed in the DSP 1620. In a similar manner, signals to be transmitted are processed, including modulation and encoding for example, by DSP 1620 and input to transmitter 1614 for digital to analog conversion, frequency up conversion, filtering, amplification and transmission over the communication network 1619 via antenna 1618. DSP 1620 not only processes communication signals, but also provides for receiver and transmitter control. For example, the gains applied to communication signals in receiver 1612 and transmitter 1614 may be adaptively controlled through automatic gain control algorithms implemented in DSP 1620.

UE 1600 generally includes a processor 1638 which controls the overall operation of the device. Communication functions, including data and voice communications, are performed through communication subsystem 1611. Processor 1638 also interacts with further device subsystems such as the display 1622, flash memory 1624, random access memory (RAM) 1626, auxiliary input/output (I/O) subsystems 1628, serial port 1630, one or more keyboards or keypads 1632, speaker 1634, microphone 1636, other communication subsystem 1640 such as a short-range communications subsystem and any other device subsystems generally designated as 1642. Serial port 1630 could include a USB port or other port known to those in the art.

Some of the subsystems shown in FIG. 16 perform communication-related functions, whereas other subsystems may provide "resident" or on-device functions. Notably, some subsystems, such as keyboard 1632 and display 1622, for example, may be used for both communication-related functions, such as entering a text message for transmission over a communication network, and device-resident functions such as a calculator or task list.

Operating system software used by the processor 1638 may be stored in a persistent store such as flash memory 1624, which may instead be a read-only memory (ROM) or similar storage element (not shown). Those skilled in the art will appreciate that the operating system, specific device applications, or parts thereof, may be temporarily loaded into a volatile memory such as RAM 1626. Received communication signals may also be stored in RAM 1626.

As shown, flash memory 1624 can be segregated into different areas for both computer programs 1658 and program data storage 1650, 1652, 1654 and 1656. These different storage types indicate that each program can allocate a portion of flash memory 1624 for their own data storage requirements. Processor 1638, in addition to its operating system functions, may enable execution of software applications on the UE. A predetermined set of applications that control basic operations, including at least data and voice communication applications for example, will normally be installed on UE 1600 during manufacturing. Other applications could be installed subsequently or dynamically.

Applications and software may be stored on any computer readable storage medium. The computer readable storage medium may be a tangible or in transitory/non-transitory medium such as optical (e.g., CD, DVD, etc.), magnetic (e.g., tape) or other memory known in the art.

One software application may be a personal information manager (PIM) application having the ability to organize and manage data items relating to the user of the UE such as, but not limited to, e-mail, calendar events, voice mails, appointments, and task items. Naturally, one or more memory stores would be available on the UE to facilitate storage of PIM data items. Such PIM application may have the ability to send and receive data items, via the wireless network 1619. Further applications may also be loaded onto the UE 1600 through the network 1619, an auxiliary I/O subsystem 1628, serial port 1630, short-range communications subsystem 1640 or any other suitable subsystem 1642, and installed by a user in the RAM 1626 or a non-volatile store (not shown) for execution by the processor 1638. Such flexibility in application installation increases the functionality of the device and may provide enhanced on-device functions, communication-related functions, or both. For example, secure communication applications may enable electronic commerce functions and other such financial transactions to be performed using the UE 1600.

In a data communication mode, a received signal such as a text message or web page download will be processed by the communication subsystem 1611 and input to the processor 1638, which may further process the received signal for output to the display 1622, or alternatively to an auxiliary I/O device 1628.

A user of UE 1600 may also compose data items such as email messages for example, using the keyboard 1632, which may be a complete alphanumeric keyboard or telephone-type keypad, among others, in conjunction with the display 1622 and possibly an auxiliary I/O device 1628. Such composed items may then be transmitted over a communication network through the communication subsystem 1611.

For voice communications, overall operation of UE 1600 is similar, except that received signals would typically be output to a speaker 1634 and signals for transmission would be generated by a microphone 1636. Alternative voice or audio I/O subsystems, such as a voice message recording subsystem, may also be implemented on UE 1600. Although voice or audio signal output is generally accomplished primarily through the speaker 1634, display 1622 may also be used to provide an indication of the identity of a calling party, the duration of a voice call, or other voice call related information for example.

Serial port 1630 in FIG. 16 would normally be implemented in a personal digital assistant (PDA)-type UE for which synchronization with a user's desktop computer (not shown) may be desirable, but is an optional device component. Such a port 1630 would enable a user to set preferences through an external device or software application and would extend the capabilities of UE 1600 by providing for information or software downloads to UE 1600 other than through a wireless communication network. The alternate download path may for example be used to load an encryption key onto the device through a direct and thus reliable and trusted connection to thereby enable secure device communication. As will be appreciated by those skilled in the art, serial port 1630 can further be used to connect the UE to a computer to act as a modem.

Other communications subsystems 1640, such as a short-range communications subsystem, is a further optional component which may provide for communication between UE 1600 and different systems or devices, which need not necessarily be similar devices. For example, the subsystem 1640 may include an infrared device and associated circuits and components or a Bluetooth™ communication module to provide for communication with similarly enabled systems and devices. Subsystem 1640 may further include non-cellular communications such as WiFi or WiMAX.

Figure 17:
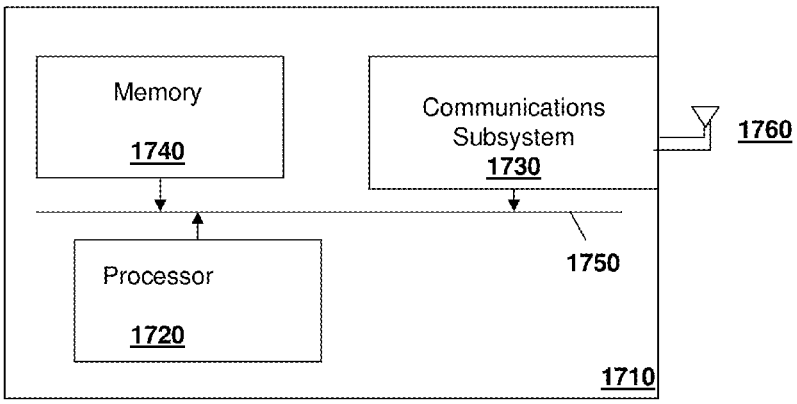
FIG. 17 shows a schematic diagram of a network element for which the antenna according to embodiments of the present matter may be used.

The above may be implemented by any network element. A simplified network element is shown with regard to FIG. 17. The network element of FIG. 17 shows an architecture which may, for example, be used for the base stations or eNBs. In FIG. 17, network element 1710 includes a processor 1720 and a communications subsystem 1730 and an antenna 1760, where the processor 1720 and communications subsystem 1730 cooperate to perform the methods of the embodiments described above.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein. For example aspects of the present matter may be described by the following statements:

A. An antenna, comprising:

a plurality of feed points; and at least one tuning element for tuning a resonant frequency at one of the plurality of feed points independently of other resonant frequencies of others of the plurality of feed points.

B. The antenna of statement A, wherein a location of the at least one tuning element is based on a current distribution on the antenna.

C. The antenna of any one of the preceding statements including a radiating element configured to have a fundamental resonance frequency being regarded as a first harmonic resonance frequency $f_o$; the feed points positioned on the configured radiating element at locations on the antenna, each for exciting a particular mode of the antenna when coupled to a feed.

D. The antenna of The antenna of any one of the preceding statements, wherein the location of the feed points are determined by using a current distribution of on a configured radiating element.

E. The antenna of any one of the preceding statements, wherein the location of the feed points are based on where multiples of a first harmonic resonance frequency have current maxima in a current distribution on the antenna.

F. The antenna of any one of the preceding statements, wherein the tuning elements are placed on the antenna such that for a given feed point its tuning element is placed on the configured radiating element where a current distribution of the other feed points is a minimum.

G. The antenna of any one of the preceding statements, wherein the tuning elements are placed on the configured radiating element so that changing value of the tuning element does not change a resonant frequency of the other feed points.

H. The antenna of any one of the preceding statements, wherein the tuning elements are capacitors.

I. The antenna of any one of the preceding statements, wherein the tuning element are connected in series with a radiating element of the antenna.

J. The antenna of any one of the preceding statements, wherein at least one of the tuning elements is connected between a radiating element of the antenna and a ground plane.

K. The antenna of any one of the preceding statements, wherein the antenna is an inverted F antenna.

L. The antenna of any one of the preceding statements, wherein the antenna is a dipole antenna.

M. The antenna of any one of the preceding statements, including feeds coupling the feed points to respective front end circuits of a mobile device, the respective front end circuits being operable in respective independent frequency bands.

N. A wireless communications device, comprising:

a multiple port multiple frequency band antenna structure having a contiguous radiating element, each of the multiple ports operable in a respective one of the multiple frequency bands; and tuning elements for tuning a resonant frequency at one of the multiple ports independently of the resonant frequency of others of the multiple ports.

O. A method for an antenna comprising:

configuring a radiating element with a plurality of feed points; and placing a tuning element on the configured radiating element for tuning a resonant frequency of at least one feed point independently of the others of the plurality of feed points.

P. The method of any one of the preceding statements, including determining a location of a current minimum for the others of the plurality of feed points.

Q. The method of any one of the preceding statements, including determining a value of the tuning element for the resonant frequency of the at least one feed point and connecting the determined tuning element at said location of the current minimum.

R. The method of any one of the preceding statements, including operating said antenna with one of said plurality feed points open, wherein the antenna forms an antenna structure of a first type operable in a first frequency band; and operating said antenna with another of said plurality feed points open, wherein the antenna forms the antenna structure of a second type operable in a second frequency band.

S. The method of any one of the preceding statements, wherein a change in a geometric dimension of said antenna structure of said first type or said second type changes said respective first frequency band or second frequency band independently.

T. The method of any one of the preceding statements, wherein each of the plurality of feed points is connected to a respective front end of a mobile device.

U. A method for making an antenna according to any one or more of the preceding statements.

The invention claimed is:

1. An antenna, comprising:

a radiation element having at least one adjustable tuning element positioned on the radiation element, the radiation element configured to resonate at a fundamental frequency when excited at a first feed point;

a second feed point positioned on the configured radiation element, the position of the second feed point located at a current distribution maxima of a harmonic of the fundamental frequency; and the at least one adjustable tuning element positioned on said radiation element at a location displaced along said radiation element from said first and second feed point locations so that adjustment of a value of said tuning element tunes a resonant frequency of the second feed point with no effect on the resonant frequency of the first feed point.

2. The antenna of claim 1, wherein a location of the at least one adjustable tuning element is based on a current distribution on the antenna.

3. The antenna of claim 1, further including a plurality of feed point locations wherein the feed point locations are determined by using a current distribution of different harmonics of the fundamental frequency of the configured radiating element.

4. The antenna of claim 3, wherein the plurality of feed point locations on the radiation element are based on where the different harmonics have current maxima.

5. The antenna of claim 3, further including a plurality of tuning elements wherein respective positions of the plurality of tuning element is at a minima of a current distribution of the plurality of feed point locations.

6. The antenna of claim 3, wherein the at least one tuning element is placed on the configured radiating element so that changing a value of the tuning element does not change a resonant frequency at the plurality of feed point locations.

7. The antenna of claim 1, wherein the tuning element is a capacitor.

8. The antenna of claim 1, wherein the at least one tuning element is connected in series with the configured radiating element of the antenna.

9. The antenna of claim 1, wherein the at least one of the tuning elements is connected between the configured radiating element of the antenna and a ground plane.

10. The antenna of claim 1, wherein the antenna is an inverted F antenna.

11. The antenna of claim 1, wherein the antenna is a dipole antenna.

12. The antenna of claim 1, including feeds coupling the feed point locations to respective front end circuits of a mobile device, the respective front end circuits being operable in respective independent frequency bands.

13. A method for an antenna comprising:

configuring a radiation element to resonate at a fundamental frequency when excited at a first feed point, the radiation element having at least one adjustable tuning element positioned on the radiation element;

positioning a second feed point on the configured radiation element, the position of the second feed point located at a current distribution maxima of a harmonic of the fundamental frequency;

placing the at least one adjustable tuning element on the configured radiating element at a location displaced along said radiation element from said first and second feed point locations; and adjusting said tuning element value to tune a resonant frequency of the second feed point with no effect on the resonant frequency of the first feed point.

14. The method of claim 13, including determining a location of a minimum for the current distribution along the radiation element for the resonant frequencies of others of the plurality of feed points.

15. The method of claim 14, including determining a value of the tuning element for the resonant frequency of the at least one feed point and connecting the determined tuning element at said location of the minimum.

16. The method of claim 13, including operating said antenna with one of said plurality feed points open, wherein the antenna forms an antenna structure of a first type operable in a first frequency band; and operating said antenna with another of said plurality feed points open, wherein the antenna forms the antenna structure of a second type operable in a second frequency band.

17. The method of claim 16, wherein a change in a geometric dimension of said antenna structure of said first type or said second type changes said respective first frequency band or second frequency band independently.

18. The method of claim 13, wherein each of the plurality of feed points is connected to respective front end circuitry of a mobile device.

* * * * *